US005297541A

United States Patent [19]

Hensey

[11] Patent Number: 5,297,541

[45] Date of Patent: Mar. 29, 1994

[54] ATHLETIC THERAPEUTIC GLOVE

[76] Inventor: Franz Hensey, 18182 Ceres St., Fontana, Calif. 92355

[21] Appl. No.: 436,370

[22] Filed: Nov. 14, 1989

[51] Int. Cl.[5] ..... A61H 1/02; A61F 5/10

[52] U.S. Cl. ..... 601/40; 482/47

[58] Field of Search ..... 128/26, 77, 24 R, 878, 128/879; 272/67, 119; 482/47, 44, 111; 602/21, 22

[56] References Cited

U.S. PATENT DOCUMENTS

| | | | |
|---|---|---|---|
| 505,745 | 9/1893 | Barclay | 128/26 U X |
| 2,880,721 | 4/1959 | Corcoran | 128/26 U X |
| 4,619,250 | 10/1986 | Hasegawa | 128/26 |
| 4,807,606 | 2/1989 | Hasegawa et al. | 128/77 |
| 4,830,360 | 5/1989 | Carr, Jr. | 482/47 |
| 4,899,763 | 2/1990 | Sebastian | 128/77 |

FOREIGN PATENT DOCUMENTS

| | | | |
|---|---|---|---|
| 2008957 | 6/1979 | United Kingdom | 128/26 |

*Primary Examiner*—Richard J. Apley
*Assistant Examiner*—John P. Leubecker
*Attorney, Agent, or Firm*—William M. Harris

[57] ABSTRACT

A glove-like device, which may be fabricated in the form a glove, mitten or mitt, for actively exercising the muscles of the fingers, hand, wrist and forearm. A glove fabricated from a flexible non-extensible material having a plurality of elongated tube shaped inflatable elastomeric bladders contained within pockets of like material attached to the upper outer surface of the glove from the tips of the fingers and thumb extending behind the knuckles. The bladders are attached to and pressurized through a manifold attached to the top surface of the glove behind the knuckles. The manifold is pressurized through a valve containing inlet/outlet tube the amount of pressure being indicated by a pressure gauge connected to the rear of the manifold. Additionally a bladder is contained within a pocket located on the palm of the glove which inflates into a flexible ball-like structure.

9 Claims, 10 Drawing Sheets

ATHLETIC THERAPEUTIC GLOVE

BACKGROUND

1. Field of Invention

The present invention relates to an athletic therapeutic glove operated actively by the user and intended to strengthen the musculature of the fingers, hand, wrist and forearm by exercise.

2. Discussion of Related Art

A variety of therapeutic hand exercising devices have been perfected in order to provide for passive exercise of the hands and fingers whose function has been impaired by disease or injury. They vary in their complexity and are operated either by fluid or by mechanical means.

Takahashi et al., U.S. Pat. No. 4,596,240 have devised a ballonet with finger engaging members on its outer surface. Intermittent pressurization and depressurization allows both extension and fanning motions of the fingers exercising the carpel joint, hand and fingers. Hasegawa, U.S. Pat. No. 4,522,197 has perfected a complicated glove shaped body with sacs disposed between the fingers and on the palm of the glove. The fingers and carpel joints of a hand placed inside of the glove are passively exercised by the charge and discharge of compressed air into and out of the glove. In U.S. Pat. No. 4,274,399 Mummert describes a mitt with an array of attached bladders which when successively pressurized and depressurized by a fluid results in a passive flexing of the finger joints. Bartholome, U.S. Pat. No. 3,937,215 has devised a therapeutic hand exerciser which provides a cyclic flexing motion to exercise the fingers. As air pressure inflates a splint-like upper member the fingers are straightened and upon deflation of the splint-like member and inflation of a wrist pouch a flap is tightened pulling the fingertips down and curling the fingers towards the palm. A complicated air pressurizing system is required to operate the device. U.S. Pat. No. 3,457,912 to Clark et al. describes a complex pneumatically actuated system for extending and closing the fingers which uses inflation to extend the fingers but depends upon driven cords to close the fingers. The device passively exercises the fingers with both flexing and extension motion. Viau in Canadian Patent No. 735,700 describes a therapeutic glove intended to extend the fingers of hands afflicted with paralysis. The glove has an inflatable bladder attached to the palmar side with extensions under the fingers and thumb. A hand is placed in the glove on top of the bladder and under the top side of the glove. The glove is inflated through a valve molded into the bladder by use of a rubber bulb causing the fingers to be straightened. The device is simple to use but in contrast to the more complicated devices described does not provide for a continuous cyclic exercising motion.

U.S. Pat. No. 4,576,148 of Koerner et al. and U.S. Pat. No. 3,756,222 of Ketchum describe rather complicated mechanically driven devices which provide a flexing motion for passively exercising the fingers and carpel joints.

All of the above mentioned appliances are designed to provide passive exercise to the afflicted members. The fluid operated devices variously require air pumps, manifolds, valves and timers; the mechanically operated devices require motors, complex driving mechanisms and microprocessor controls. With the exception of Viau's Therapeutic Glove these exercisers are expensive to manufacture and their use is restricted to physical therapy facilities as their operation is rather complicated and necessitate exacting adjustments.

SUMMARY OF THE INVENTION

In its basic form the present invention comprises a glove with inflatable elastomeric bladders contained within elongated fabric pockets attached to the dorsal surface of the finger and thumb sections of the glove. The bladders are attached to and inflated through a distribution manifold mounted on the dorsal surface of the glove behind the knuckles. The bladders are pressurized and depressurized through the valve containing manifold inlet/outlet tube. The amount of pressurization is indicated by a pressure gauge connected to the manifold. A hand operated rubber bulb may be conveniently employed as a source of compressed air.

A primary object of this invention is to provide a device for personally actively exercising the muscles of the fingers, hand, wrist and forearm. By inflating the elastomeric bladders the fingers and thumb are extended. By flexing the hand to form a fist the muscles must overcome the tension in the bladders which is adjusted by feel or the pressure gauge to the requirements of the user.

A further object of the invention is to provide therapeutic exercise for the fingers and joints of physically impaired hands retaining at least a limited muscular function. Initially the exercise can be against the elastic force of the uninflated bladders only. As the muscles gain strength a very low air pressure can be introduced into the bladder. The pressure gauge provides users a sensitive adjustment for gradually increasing the pressure as the muscles and joints gain in strength.

Still another object is to provide for exercise under variable temperature conditions by using water or any other suitable fluid at the desired temperature to pressurize the bladders.

An additional object of this invention is to provide a simple exercise device which is portable and may be used while engaging in other forms of exercise such as jogging or active sports for example baseball, football etc.

A variation of the basic design has a small bladder located on the palmar surface of the glove in addition to the aforementioned finger and thumb bladders. When the user desires this palmar bladder may be inflated providing a flexible ball-like structure against which the muscles may squeeze for an additional exercise mode.

Further embodiments of my invention employ the above mentioned bladders, manifold and pressure gauge attached in a like manner in mittens or mitts.

Another variation of the invention employs a detachable weighted cuff on the wrist portion of the glove, mitten or mitt for a still further exercise mode.

These and other objects and advantages of the present invention will no doubt become apparent to those skilled in the art after having read the following detailed description of the preferred embodiments which are contained in and illustrated by the various drawing figures.

The exercise devices discussed above under related art are complicated, not portable, require complicated pressure adjustments and cannot be employed in everyday encounters. In contrast the present invention is portable, easy to use and permits simple variable pressure control by the user.

DESCRIPTION OF THE PREFERRED EMBODIMENTS

Figure 1:
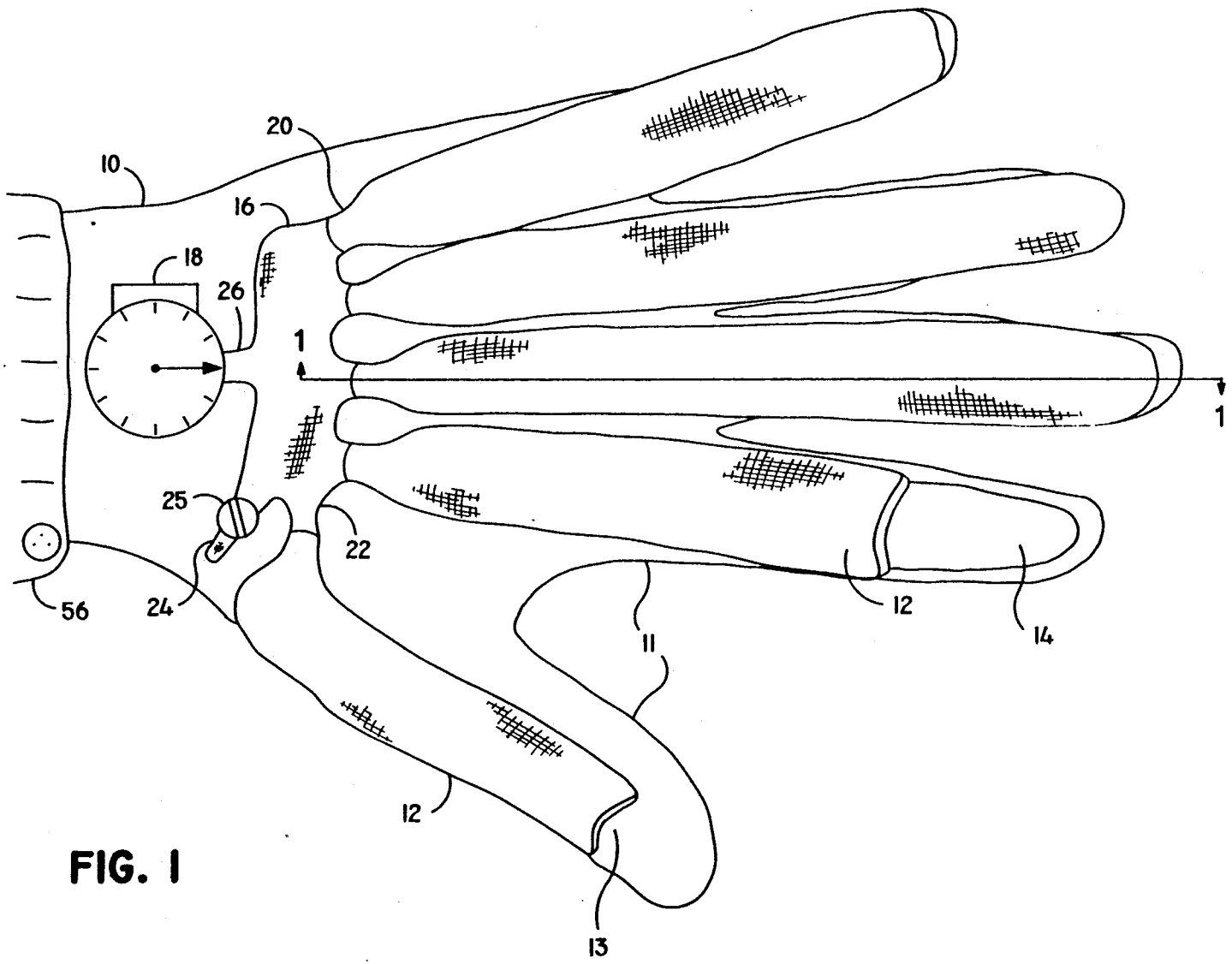
FIG. 1 is a partly broken away plan view of the glove viewed from the top or dorsal side according to the first embodiment of the present invention.

FIG. 1 in a partially cut away plan view illustrates the preferred embodiment for the athletic therapeutic glove. The invention in its basic form comprises a glove 10 fabricated from a suitable flexible non-extensible material preferably fabric or leather. A plurality of composite fabric strips 12 are attached, preferably by sewing or weaving, to the dorsal surface of the finger-thumb sections 11 of glove 10. Composite fabric strips 12 extend substantially from the tip of finger sections 11 to just behind the knuckles and one strip 12 substantially from the tip of thumb section 11 to approximately the base of the thumb. The attached composite strips 12 form a plurality of elongated tubular pockets 13. A plurality of elongated tube shaped inflatable elastomeric bladders 14 are contained within pockets 13. The elastomeric bladders 14 are formed preferably from latex rubber. Distribution manifold 16 is attached to the dorsal surface of the hand of glove 10 just behind the knuckles. Bladders 14 are connected to manifold finger exhaust tubes 20 and thumb exhaust tube 22. Manifold 16 and bladders 14 are pressurized through valve containing inlet/outlet tube 24 which extends angularly rearward on the thumb side or inside of manifold 16. Extending rearward from the center of manifold 16 is exhaust tube 26 to which pressure gauge 18 is attached. An optional detachable weighted cuff 56 is shown on the wrist section of glove 10.

Figure 2:
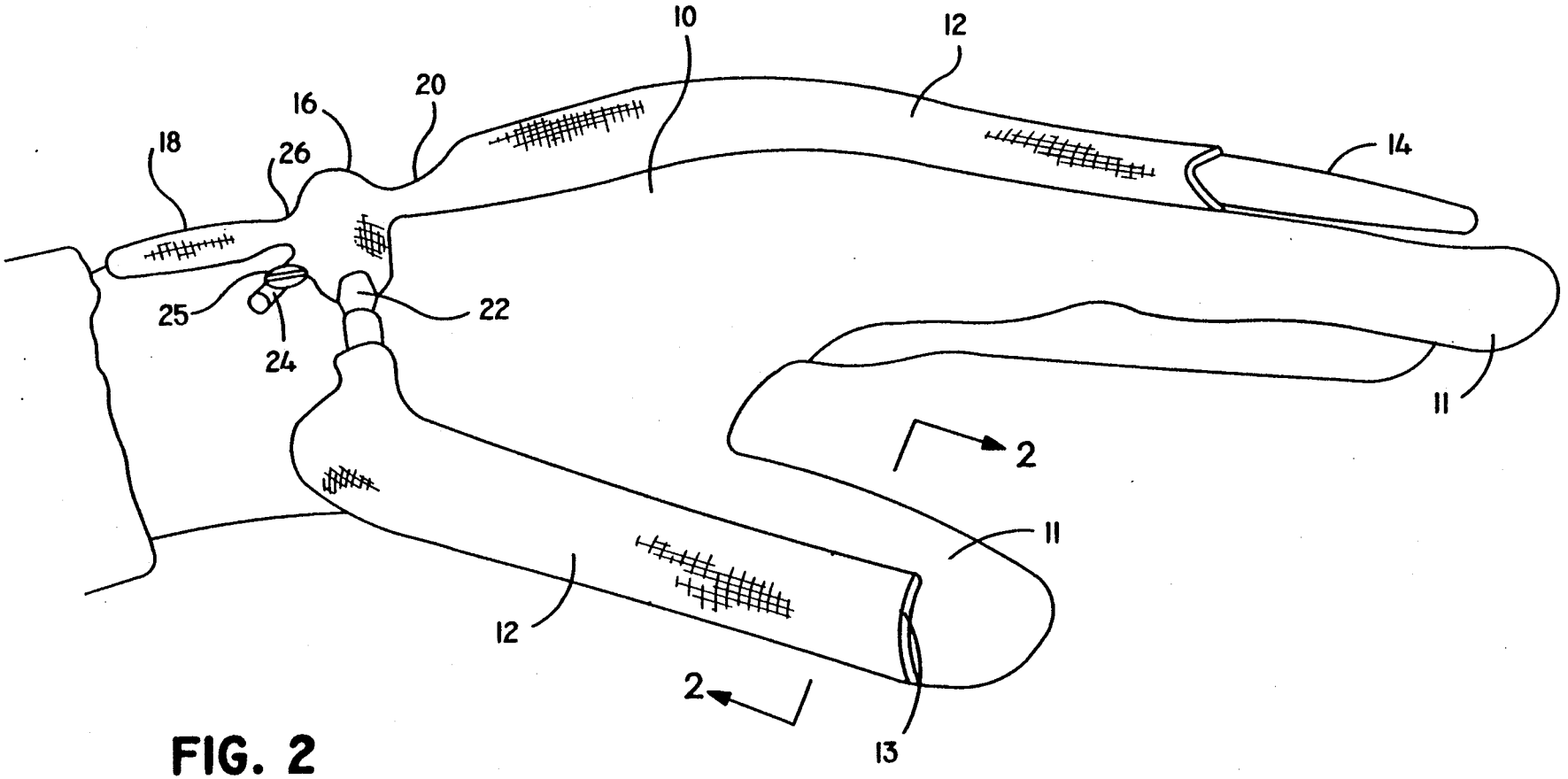
FIG. 2 is a partly broken away side view of the glove according to the first embodiment of the present invention.

FIG. 2 shows the preferred embodiment of the athletic therapeutic glove in a partially cut away side view.

Figure 3:
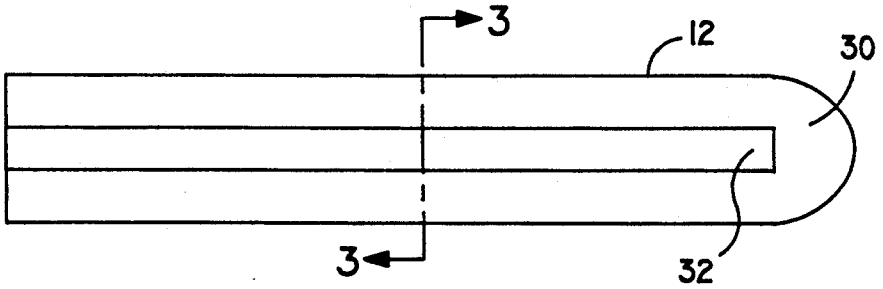
FIG. 3 is a plan view of the inner surface of the composite fabric strip.

FIG. 3 is a plan view of the inner surface of composite fabric strip 12 comprising outer fabric strip 30 and inner reinforcing fabric strip 32. Fabric strips 30 are rounded on the finger-thumb end and are of variable length extending from approximately the tip of the finger sections 11 to just behind the knuckles and one strip 30 extending from approximately the tip of the thumb section 11 to approximately the base of the thumb. Fabric strips 30 are of such a width that when the peripheral edges are attached to the dorsal surface of the finger-thumb sections 11 and hand of glove 10 elongated tubular shaped pockets 13 are formed with a diameter of approximately one half the diameter of the finger-thumb sections 11. Reinforcing fabric strips 32 are approximately one third of the maximum width of fabric strips 30 and extend the length of fabric strips 30. Fabric strips 32 are preferably adhesively attached to fabric strips 30.

Figure 4:
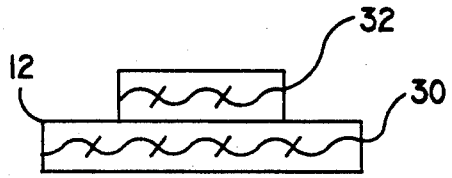
FIG. 4 is an enlarged cross sectional view of the composite fabric strip taken through line 3—3 of FIG. 3.

FIG. 4 is an enlarged cross sectional view of the composite fabric strip taken along line 3—3 of FIG. 3 showing the relative placement of fabric strips 30 and 32 comprising fabric strip 12.

Figure 5:
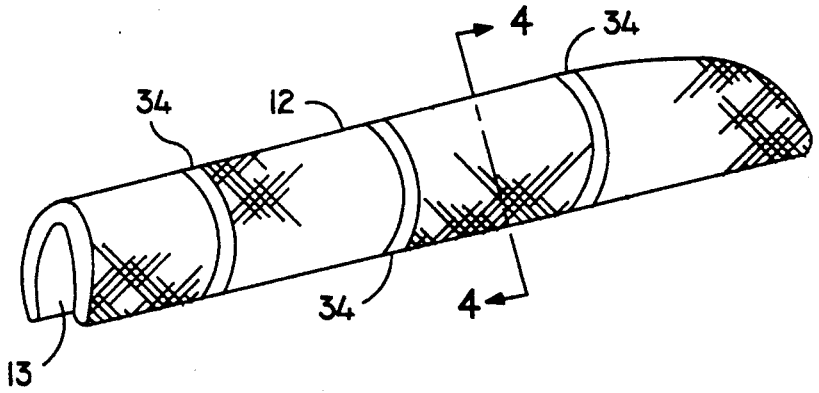
FIG. 5 is a perspective view of the composite fabric strip as it appears when attached to the finger-thumb sections of the glove.

FIG. 5 is a perspective view of composite fabric strip 12 formed into the semicircular shape it will assume when attached to the dorsal surface of the finger-thumb sections 11 of glove 10. Cross stitching 34 at the finger-thumb joints provides further reinforcement and in conjunction with reinforcing fabric strips 32 prevent ballooning of tubular pockets 13 when bladders 14 are pressurized.

Figure 6:
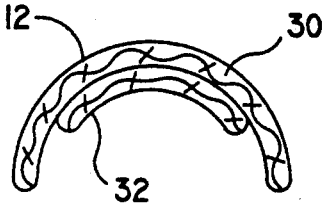
FIG. 6 is an enlarged cross sectional view of the composite fabric strip taken through line 4—4 of FIG. 5.

FIG. 6 is an enlarged cross sectional view of composite fabric strip 12 taken along line 4—4 of FIG. 5.

Figure 7:
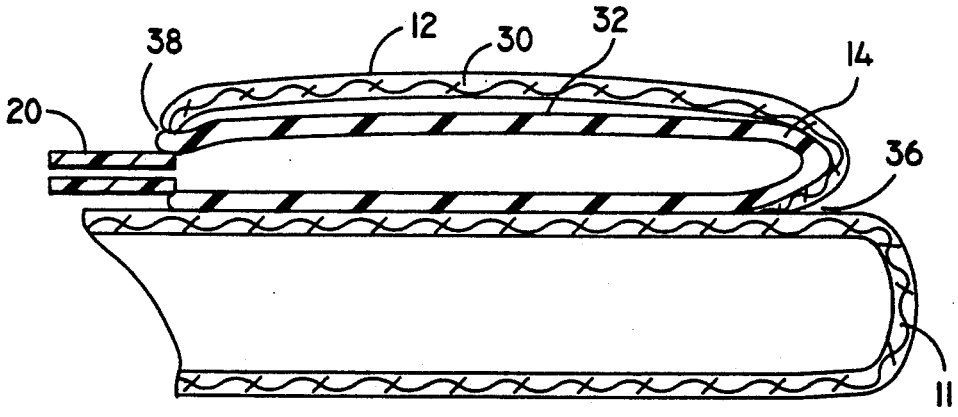
FIG. 7 is a partial enlarged longitudinal cross sectional view of the finger section of the glove taken along line 1—1 of FIG. 1.

FIG. 7 is a partial enlarged longitudinal cross sectional view of finger section 11 of glove 10 taken along line 1—1 of FIG. 1. Composite fabric strip 12 is attached preferably by weaving or sewing around the peripheral edges to the dorsal surface of the finger section 11 and hand of glove 10 at 36 forming an elongated tubular pocket closed at the finger tip end and open at the opposite end at 38. Latex rubber bladder 14 is contained within tubular shaped pocket 13 and is attached by the elastic force of the rubber to finger exhaust tube 20.

Figure 8:
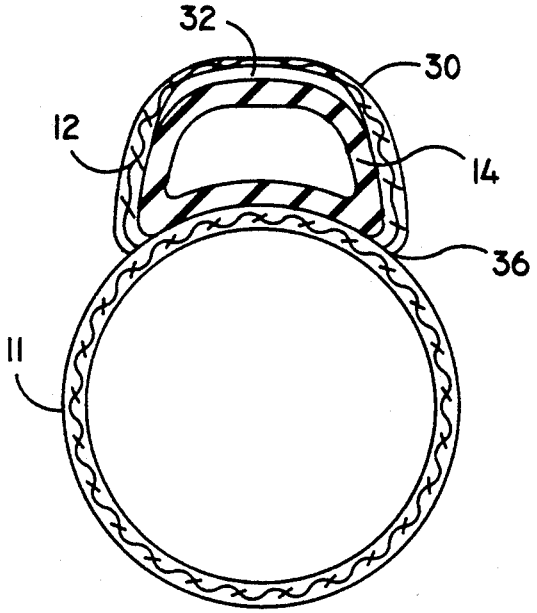
FIG. 8 is an enlarged transverse cross sectional view of the finger of the glove taken along line 2—2 of FIG. 2.

FIG. 8 in an enlarged transverse cross sectional view of the finger of glove 10 taken along line 2—2 of FIG. 2 shows composite fabric strip 12 attached at its peripheral edge to the dorsal surface of finger section 11 at 36 forming pocket 13 containing bladder 14.

Figure 9:
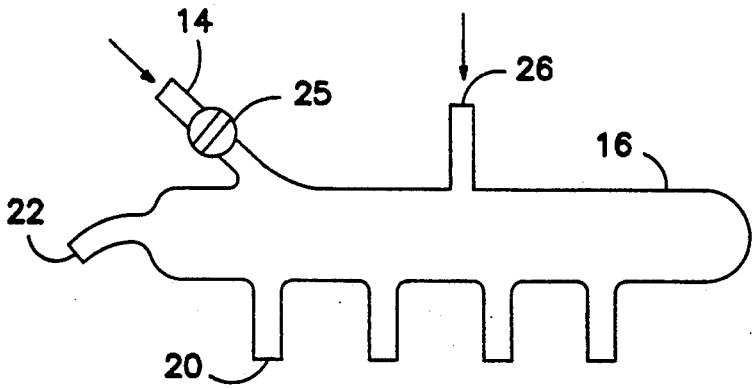
FIG. 9 is a plan view of a distribution manifold attached to the dorsal surface of the hand of the glove.
Figure 10:
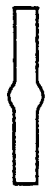
FIG. 10 is a side view of an alternative form of a manifold exhaust tube.

Distribution manifold 16 shown in FIG. 9 is attached to the dorsal surface of the hand of glove 10 just posterior to the knuckles and may be secured by a variety of methods such as clamping, gluing or stitching. Four finger bladder exhaust tubes 20 located substantially at the center positions of finger pockets 13 extend in a forward direction from manifold 16 and one thumb bladder exhaust tube 22 extends from the thumb side of manifold 16. Inlet/outlet tube 24 through which manifold 16 and bladders 14 are pressurized extends angularly rearward from manifold 16 on the thumb side. Valve 25 is deployed in inlet/outlet tube 24. Extending rearward from the center of manifold 16 is male threaded exhaust tube 26 to which pressure gauge 18 is attached by a female thread. The rigid manifold 16 may be molded from a thermoplastic, for example nylon, polyvinyl chloride or polypropylene. Exhaust tubes 20 and 22 may be smooth or as shown in FIG. 10 have a circularly extending smooth ridge to better retain bladders 14. Inlet/outlet tube 24 which contains valve 25 is preferably male screw threaded. Valve 25 is hand operated and may be a gate valve or a combination of a Schrader valve with a locking device which allows easy and rapid pressurization and depressurization of bladders 14. A hand operated rubber bulb may be used to provide a compressed air supply.

The athletic therapeutic glove is operated as follows: The hand is placed in glove 10. Valve 25 is opened and compressed air or a suitable liquid is injected through inlet/outlet tube into manifold 16 thereby expanding bladders 14. When the desired pressure is achieved determined either by feel or as indicated on pressure gauge 18 valve 25 is closed and the pressurizing means disconnected from inlet/outlet tube 24. By alternately clenching the fingers into a fist and opening them the muscles of the fingers, hand, wrist and forearm are exercised against the tension of the inflated bladders 14. At the end of the exercise period valve 25 is opened depressurizing bladders 14. If desired exercise may be conducted only against the resistance of the uninflated rubber bladders. Exercise under variable temperature conditions is effectuated by using water or any other suitable liquid at the desired temperature to pressurize bladders 14. Additionally weighted cuff 56 may be attached to the wrist of glove 10 if desired.

Figure 14:
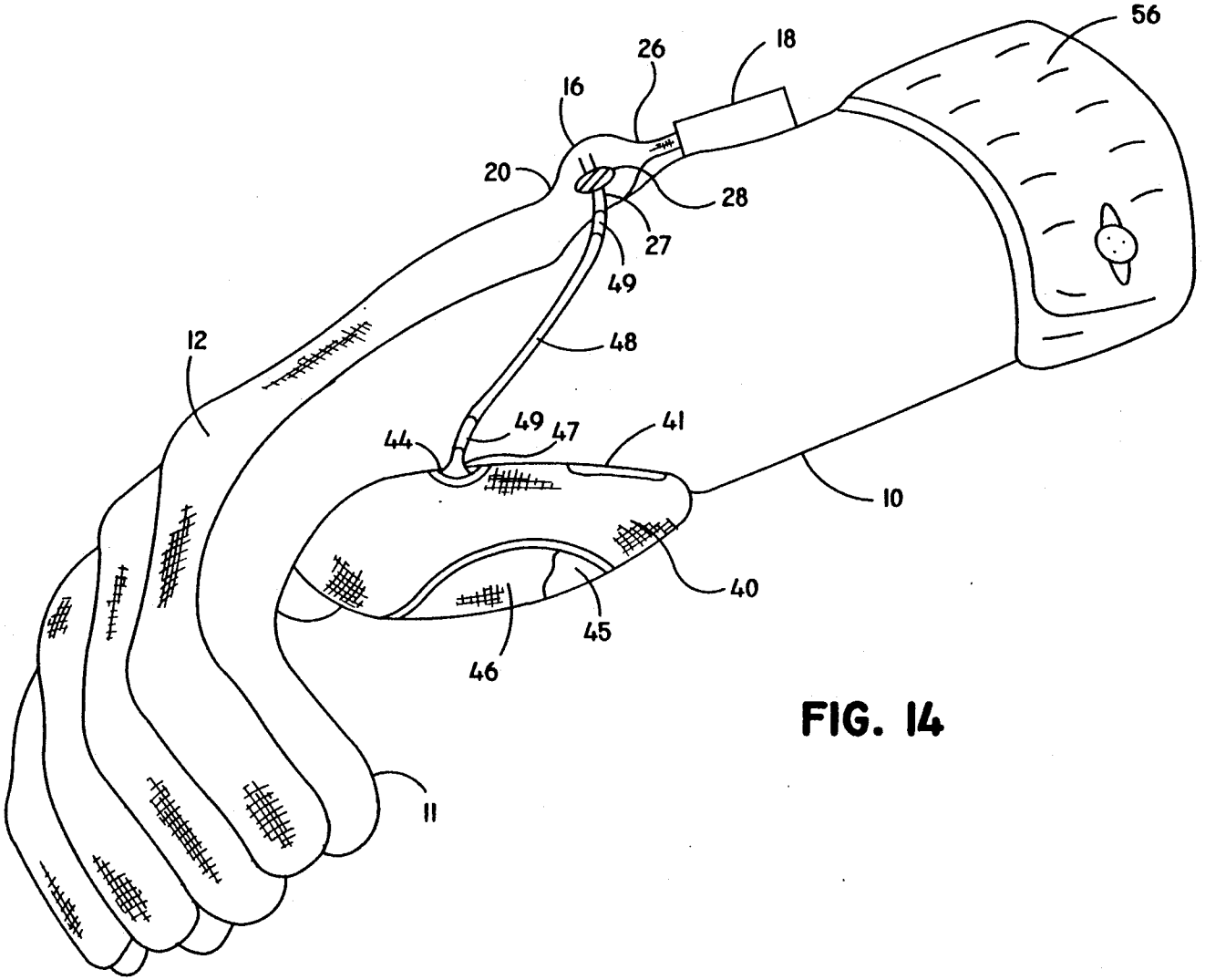
FIG. 14 is a side view of the glove partially cut away illustrating the palmar encasing fabric pocket and inflatable palmar bladder according to the second embodiment of the invention.

In FIG. 14 there is shown another embodiment of the present invention in which composite fabric palmar cover 40 is attached to the palmar surface of glove 10 at 41 forming palmar pocket 45 which encloses inflatable elastomeric palmar bladder 46. Composite palmar cover 40 is attached around its peripheral edge by sewing or weaving to the palmar surface of glove 10 except for a small section of the periphery below the base of the little finger forming a small orifice 44 through which the palmar bladder inlet tube 47 extends. Palmar bladder inlet tube 47 is attached to palmar bladder exhaust tube 27 of a modified design of manifold 16 shown in FIG. 11 by a flexible non-extensible connecting tube 48 by clamps 49.

Figure 15:
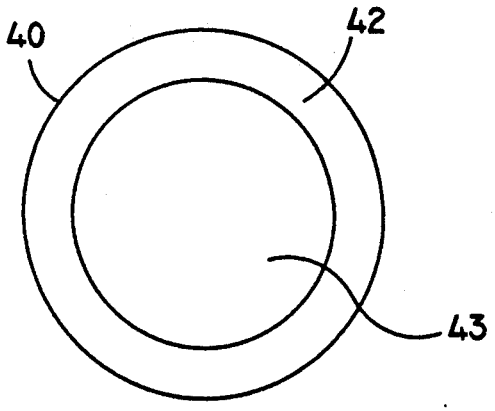
FIG. 15 is a plan view of the inner surface of the composite fabric palmar encasing cover.

FIG. 15 shows a plan view of the inner surface of composite fabric palmar bladder encasing cover 40 comprising outer fabric cover 42 and inner fabric reinforcing piece 43. Cover 40 is substantially circular in shape with a diameter slightly less than the size of the palm of glove 10. Reinforcing piece 43 is preferably adhesively attached to the inner surface of outer cover 42 and is the same shape as outer cover 42 with a diameter slightly less than outer cover 42.

Figure 16:
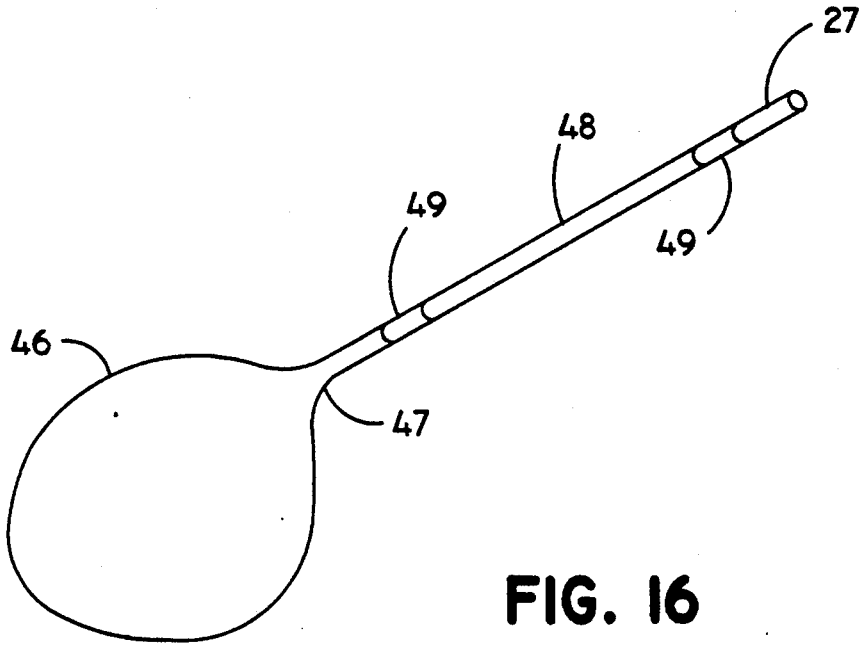
FIG. 16 is a plan view of the palmar bladder showing the attachment of the bladder to the inlet tube.

FIG. 16 shows the substantially circular uninflated palmar bladder 46 connected to manifold 16 by a flexible non-extensible connecting tube 48 which is attached by clamps 49 to palmar bladder inlet tube 47 and palmar bladder exhaust tube 27. Palmar bladder 46 is preferably formed of latex rubber.

Referring again to FIG. 14 it is seen that the construction of glove 10 is as previously described with the addition of palmar bladder 46 positioned in the center of the palmar surface of glove 10 and contained within palmar pocket 45 formed by composite palmar cover 40.

Figure 11:
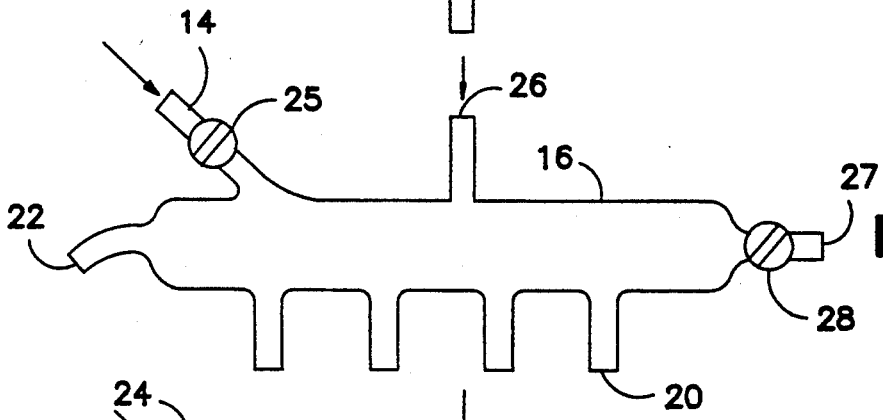
FIG. 11 is a plan view of a modified design of the manifold employed with an inflatable palmar bladder according to the second embodiment of the present invention.

FIG. 11 shows a modified design of manifold 16 with palmar bladder exhaust tube 27 extending from manifold 16 on the outside of glove 10. Gate valve 28 is deployed in exhaust tube 27.

The athletic therapeutic glove 10 with palmar bladder 46 is operated as follows: The hand is placed in glove 10. Valves 25 and 28 are opened and compressed air or other suitable fluid is injected through inlet/outlet tube 24 thereby pressurizing bladders 14 and palmar bladder 46. When the desired pressure is achieved determined by either feel or as indicated on pressure gauge 18 valve 28 is closed, valve 25 is left open, and the pressurizing means disconnected. Bladders 14 remain unpressurized and palmar bladder 46 is inflated into a flexible ball-like structure. By clenching the fingers into a fist and squeezing a compressive force is exerted against inflated palmar bladder 46. Exercise is accomplished by alternately squeezing the flexible ball-like structure and relaxing the muscles. At the end of the exercise period valve 28 is opened depressurizing palmar bladder 46. If after the pressurization of bladders 14 and palmar bladder 46 valve 54 is left open, valve 25 closed, and the pressurizing means disconnected from inlet/outlet tube 24 both finger-thumb bladders 14 and palmar bladder 46 will be inflated. Exercise may be performed as described against both inflated bladders 14 and 46.

Figure 17:
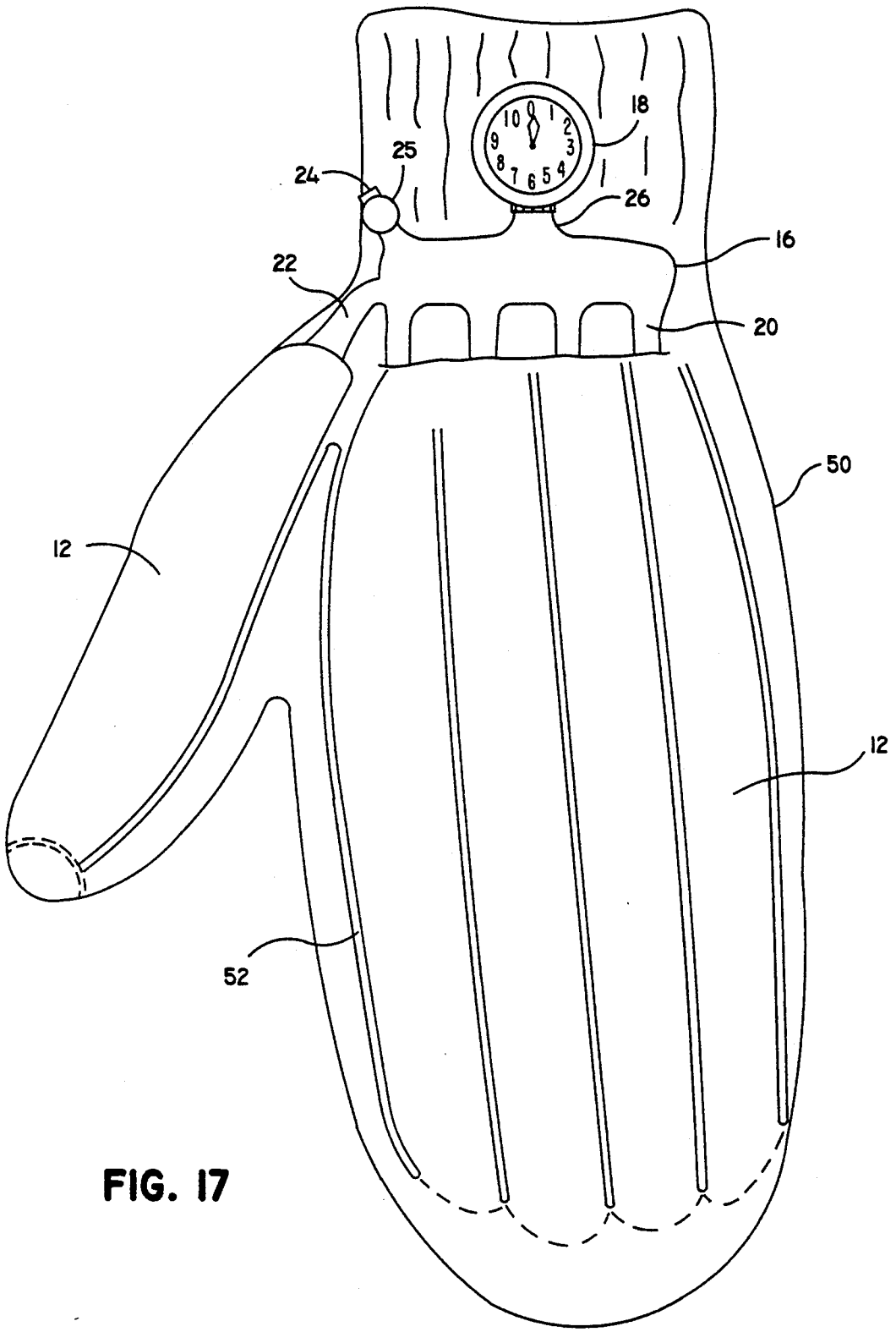
FIG. 17 is a plan view according to the third embodiment of the present invention in the form of a mitten.

In FIG. 17 there is shown another embodiment of the invention in the form of a mitten 50. The construction and operation of the mitten are substantially the same as glove 10, except that the plurality of composite fabric strips 12 are attached parallel to the dorsal surface of mitten 50 preferably by elongated rows of saddle stitching or reinforced ribbing at 52.

Figure 18:
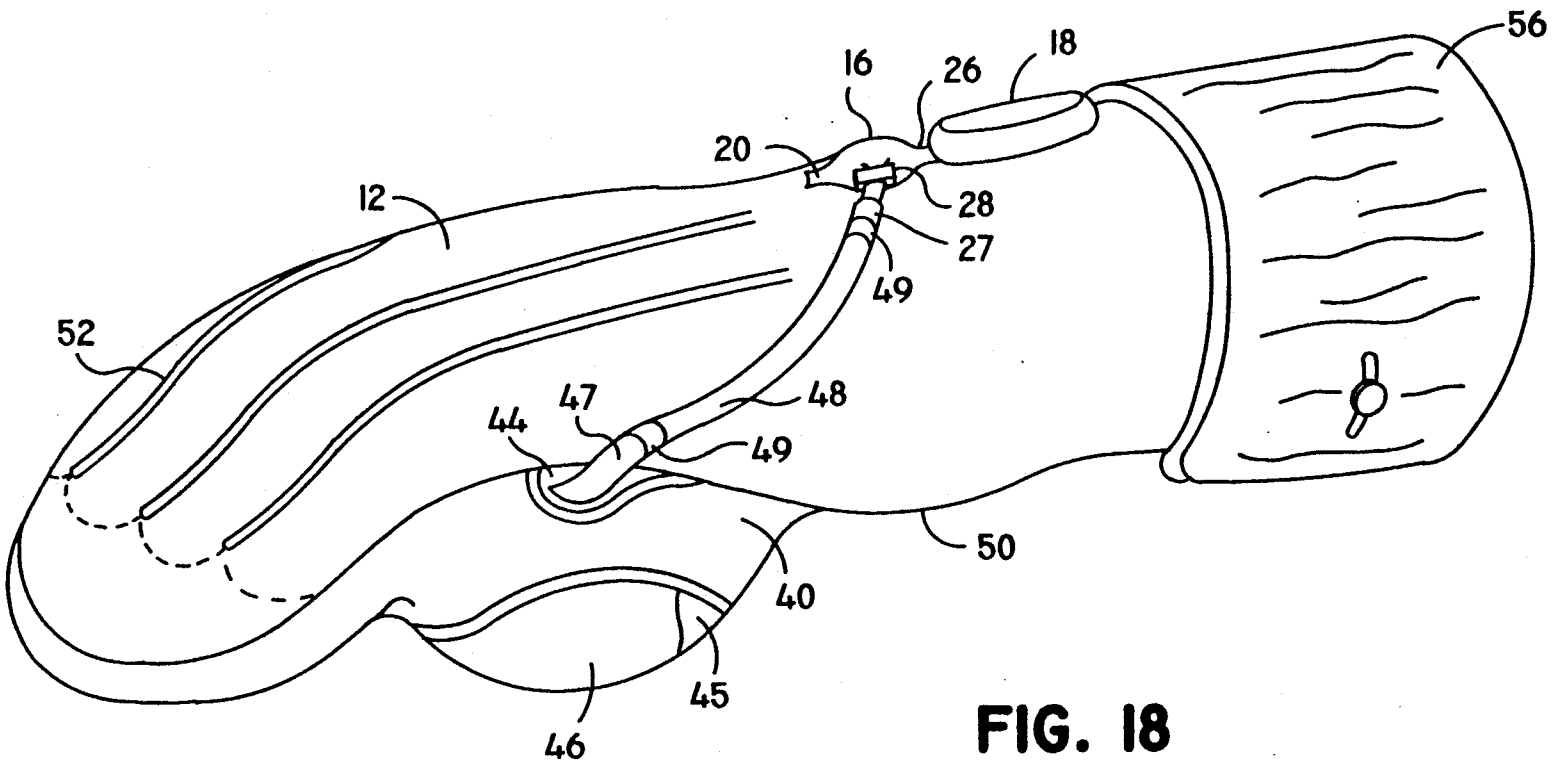
FIG. 18 is a side view of the mitten or mitt partially cut away illustrating the palmar bladder encasing pocket and inflatable palmar bladder.

FIG. 18 illustrates further embodiments of the present invention in the form of a mitten 50 or mitt 54 with palmar bladder 46. The construction and operation of these embodiments are substantially the same as discussed in FIGS. 14 and 17.

Figure 12:
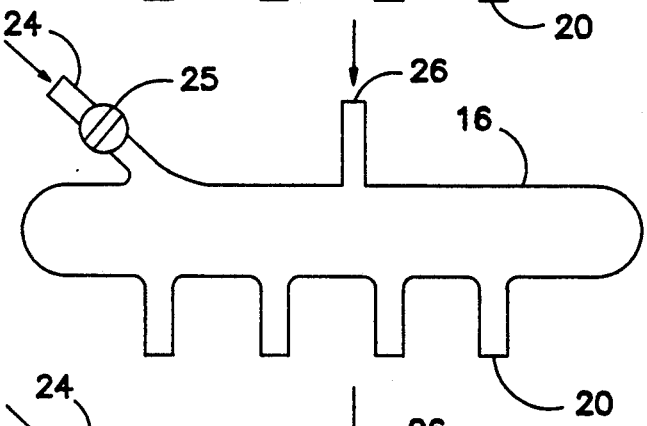
FIG. 12 is a plan view of a modified design of the manifold according to an alternative embodiment of the invention designed for use with a mitt.
Figure 13:
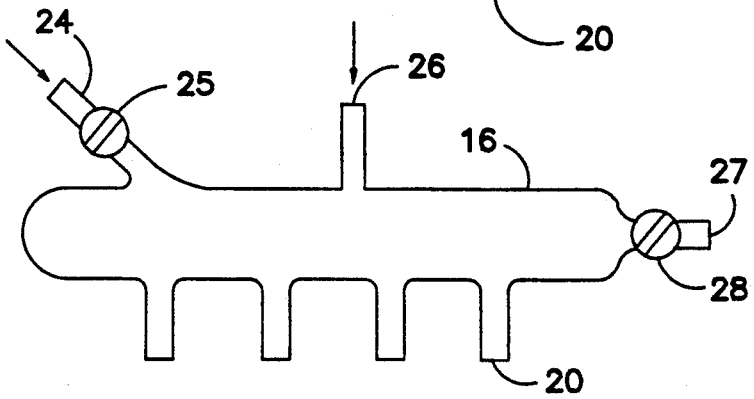
FIG. 13 is a plan view of a modified design of the manifold according to an alternative embodiment of the invention designed for use with a mitt in conjunction with an inflatable palmar bladder.
Figure 19:
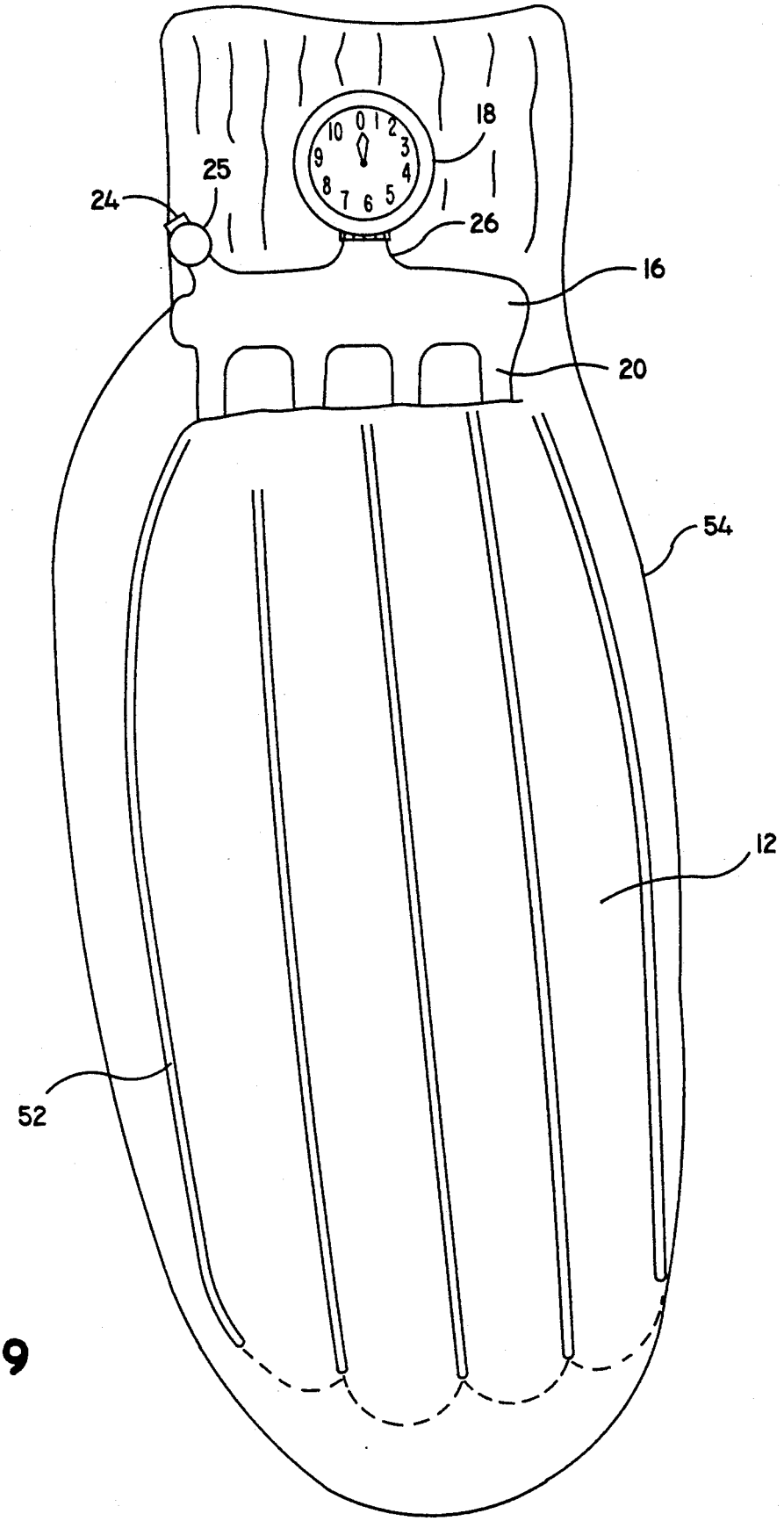
FIG. 19 is a plan view according to the embodiment of the present invention in the form of a mitt.

FIG. 19 shows a still further embodiment of the invention in the form of a mitt 54. The construction and operation are the same as described in FIG. 17 except for the thumb section which is absent in mitt 54. The modified manifold shown in FIG. 12 is used with this embodiment.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. An athletic therapeutic glove for the active exercise of the muscles of the fingers, hand, wrist and forearm, comprising in combination:

a glove formed of a flexible non-extensible material;

a plurality of elongated strips formed of said flexible non-extensible material attached to the dorsal surface of the finger sections of said glove said strips extending from the tip of the finger sections to just behind the knuckles and one strip extending from substantially the tip of the thumb section of said glove to approximately the base of the thumb, said strips being attached around their periphery except at the posterior end;

a plurality of elongated tubular pockets formed by said attached strips;

a plurality of elongated tubular elastomeric bladders contained within said pockets;

a manifold attached to the dorsal surface of the hand of said glove behind the knuckle region said manifold having an inlet/outlet tube, a valve deployed in said inlet/outlet tube, a plurality of forwardly facing finger bladder exhaust tubes located substantially at the center positions of said pockets, a sideways facing thumb bladder exhaust tube on the inward side of said glove, a rearward facing exhaust tube located in the center of said manifold, said bladders being attached to said finger and thumb bladder exhaust tubes; means for fluid pressurization of said bladders through said valve in said inlet/outlet tube;

means for measuring the pressure in said bladders said means attached to said rearward facing exhaust tube;

a substantially circular palmar cover of said flexible non-extensible material attached to the palmar surface of said glove around the periphery of said cover except for a small section of the periphery below the base of the little finger of said glove forming a small orifice;

a palmar pocket formed by said attached palmar cover;

a substantially circular elastomeric palmar bladder with a short inlet tube contained within said palmar pocket said palmar bladder inlet tube extending through said small orifice;

a palmar bladder exhaust tube extending sideways from said manifold on the outside of said glove;

a valve deployed in said palmar bladder exhaust tube;

a flexible non-extensible tube attached to said palmer bladder inlet tube and to said palmar bladder exhaust tube whereby opening said palmar bladder exhaust tube valve to said fluid pressurizing means allows said palmar bladder to be inflated forming a flexible ball-like structure.

2. An athletic therapeutic glove for the active exercise of the muscles of the fingers, hand, wrist and forearm, comprising in combination:

a mitten formed of a flexible non-extensible material;

a plurality of elongated parallel strips formed of said flexible non-extensible material located on the dorsal surface of said mitten substantially over the position of the fingers of a hand when inserted in said mitten said strips extending substantially from the tip of the mitten to just behind the knuckles and one strip extending from substantially the tip of the thumb section of said mitten to approximately the base of the thumb said strips being attached to the dorsal surface of the mitten and thumb by elongated rows of stitching around their periphery except at the posterior end;

a plurality of elongated tubular pockets formed by said attached strips;

a plurality of elongated tubular elastomeric bladders contained within said pockets;

a manifold attached to the dorsal surface of the hand of said mitten behind the knuckle region said manifold having an inlet/outlet tube, a valve deployed in said inlet/outlet tube, a plurality of forwardly facing finger bladder exhaust tubes located substantially at the center position of said pockets, a sideways facing thumb bladder exhaust tube on the inward side of said mitten, a rearward facing exhaust tube located in the center of said manifold, said bladders being attached to said finger and thumb bladder exhaust tubes;

means for fluid pressurization of said bladders through said valve of said manifold inlet/outlet tube;

means for measuring the pressure in said bladders said means attached to said rearward facing exhaust tube;

said mitten further comprising a substantially circular palmar cover of said flexible non-extensible material attached to the palmar surface of said mitten around the periphery of said cover except for a small section of the periphery below the base of the little finger of a hand placed in said mitten, forming a small orifice;

a palmar pocket formed by said attached palmar cover:

a substantially circular elastomeric palmar bladder with a short inlet tube contained within said palmar pocket said palmar bladder inlet tube extending through said small orifice;

a palmar bladder exhaust tube extending sideways from said manifold on the outside of said mitten;

a valve deployed in said palmar bladder exhaust tube;

a flexible non-extensible tube attached to said palmar bladder inlet tube and to said palmar bladder exhaust tube whereby opening said palmar bladder exhaust tube valve to said fluid pressurizing means allows said palmar bladder to be inflated forming a flexible ball-like structure.

3. An athletic therapeutic glove for the active exercise of the muscles of the fingers, hand, wrist and forearm, comprising in combination:

a mitt formed of a flexible non-extensible material;

a plurality of elongated parallel strips formed of said flexible non-extensible material located on the dorsal surface of said mitt substantially over the position of the fingers of a hand when inserted in said mitt said strips extending substantially from the tip of the mitt to just behind the knuckles, said strips being attached to the dorsal surface of said mitt by elongated rows of stitching around their periphery except at the posterior end;

a plurality of elongated tubular pockets formed by said attached strips;

a plurality of elongated tubular elastomeric bladders contained within said pockets;

a manifold attached to the dorsal surface of the hand of said mitt behind the knuckle region said manifold having an inlet/outlet tube, a valve deployed in said inlet/outlet tube, a plurality of forwardly facing finger bladder exhaust tubes located substantially at the center positions of said pockets, a rearward facing exhaust tube located in the center of said manifold, said bladders being attached to said finger bladder exhaust tubes;

means for fluid pressurization of said bladders through said valve of said manifold inlet/outlet tube;

means for measuring the pressure in said bladders said means attached to said rearward facing exhaust tube;

said mitt further including a substantially circular palmar cover of said flexible non-extensible material attached to the palmar surface of said mitt around the periphery of said cover except for a small section of the periphery below the base of the little finger of a hand placed in said mitt, forming a small orifice;

a palmar pocket formed by said attached palmar cover;

a substantially circular elastomeric palmar bladder with a short inlet tube contained within said palmar pocket said palmar bladder inlet tube extending through said orifice;

a palmar bladder exhaust tube extending sideways from said manifold on the outside of said mitt;

a valve deployed in said palmar bladder exhaust tube;

a flexible non-extensible tube attached to said palmar bladder inlet tube and to said palmar bladder exhaust tube whereby opening said palmar bladder exhaust tube valve to said fluid pressurizing means allows said palmar bladder to be inflated forming a flexible ball-like structure.

4. A method for actively exercising the muscles of the fingers, hand, wrist and forearm of an individual, comprising the following steps:

placing the hand in a glove formed of a flexible non-extensible material said glove having tubular shaped elastomeric bladders positioned over the dorsal surface of the finger and thumb sections of said glove by encasement in pockets of said flexible non-extensible material said bladders being attached to a manifold located on the dorsal surface of the hand of said glove behind the knuckles said manifold having a plurality of forward facing finger-thumb bladder exhaust tubes, an inward facing valve containing inlet/outlet tube, and a center located rearward facing exhaust tube to which a pressure measuring means is attached;

opening said valve in said inlet/outlet tube;

supplying pressurized fluid to said bladders through said open inlet/outlet tube valve;

adjusting the desired pressure by said pressure measuring means;

clenching the fingers and thumb into a fist and opening them alternately against the tensive force of the inflated bladders;

opening said inlet/outlet tube valve to depressurize the bladders at the end of the exercise period.

5. A method for exercise as recited in claim 4, wherein said pressurizing fluid is compressed air and said pressure measuring means is an air pressure gauge.

6. A method for exercise as recited in claim 4, wherein said pressurizing fluid is liquid water adjusted to the desired temperature and said pressure measuring means is a water pressure gauge.

7. A method for actively exercising the muscles of the fingers, hand, wrist and forearm of an individual, comprising the following steps:

placing the hand in a glove formed of a flexible non-extensible material said glove having an elastomeric palmar bladder contained within a palmar bladder cover of said flexible non-extensible material said palmar bladder being connected by a flexible non-extensible tube to a manifold located on the dorsal surface of the hand of said glove behind the knuckles said manifold having a valve containing palmar bladder exhaust tube located on the outside of said manifold, an inward facing valve containing inlet/outlet tube, and a center located rearward facing exhaust tube to which a pressure measuring means is attached;

opening said valve in said inlet/outlet tube;

opening said valve in said palmar bladder exhaust tube;

supplying pressurized fluid to said palmar bladder through said open inlet/outlet and palmar bladder exhaust tube valves;

adjusting the desired pressure by said pressure measuring means;

closing said valve in said palmar bladder exhaust tube and leaving said valve in said manifold inlet/outlet tube open;

clenching the fingers and thumb into a fist and opening them alternately thereby exerting compressive force against the inflated palmar bladder;

opening said palmar bladder exhaust tube valve to depressurize the palmar bladder at the end of the exercise period.

8. A method for exercise as recited in claim 7, wherein said pressurizing fluid is compressed air and said pressure measuring means is an air pressure gauge.

9. A method for exercise as recited in claim 7, wherein said pressurizing fluid is liquid water adjusted to the desired temperature and said pressure measuring means is a water pressure gauge.

* * * * *